United States Patent [19]

Matsuyama

[11] Patent Number: 5,002,409

[45] Date of Patent: Mar. 26, 1991

[54] PRINTER WITH UNDERLINING FUNCTION

[75] Inventor: Shigeru Matsuyama, Yokohama, Japan

[73] Assignee: Canon Kabushiki Kaisha, Tokyo, Japan

[21] Appl. No.: 314,260

[22] Filed: Feb. 24, 1989

Related U.S. Application Data

[63] Continuation of Ser. No. 45,182, Apr. 30, 1987, abandoned, which is a continuation of Ser. No. 754,440, Jul. 12, 1985, abandoned.

[30] Foreign Application Priority Data

Jul. 18, 1984 [JP] Japan ..... 59-147477

[51] Int. Cl.[5] ..... B41J 29/26

[52] U.S. Cl. ..... 400/22; 400/17

[58] Field of Search ..... 400/17–22, 400/61, 63

[56] References Cited

U.S. PATENT DOCUMENTS 3,526,887 9/1970 Erni ..... 340/711
3,780,846 12/1973 Kolpek et al. ..... 400/17
3,940,746 2/1976 Vittorelli ..... 400/63
4,233,601 11/1980 Hankins et al. ..... 340/703
4,344,713 8/1982 Cullen ..... 400/22
4,405,830 9/1983 Foster et al. ..... 340/703

FOREIGN PATENT DOCUMENTS 20385 2/1982 Japan ..... 400/17
44562 3/1983 Japan ..... 400/17
44563 3/1983 Japan ..... 400/17
185280 10/1983 Japan ..... 400/17

OTHER PUBLICATIONS

Tokunaga, "Overprint Circuit", IBM Technical Disclosure Bulletin, vol. 26, No. 1, pp. 284–285, 6/83.

*Primary Examiner*—David A. Wiecking
*Assistant Examiner*—Steven S. Kelley
*Attorney, Agent, or Firm*—Fitzpatrick, Cella, Harper, Scinto

[57] ABSTRACT

A printer having an underlining function includes an underline position memory. Each bit of the underline position memory is allotted to each printable position, and contents of bits corresponding to the underline positions are inverted.

15 Claims, 4 Drawing Sheets

| STEP | KEY OPERATION | XX / XX | $(UDL\ 1)_H$ | $(UDL\ 2)_H$ | LINE · BUFFER | PRINT |
|---|---|---|---|---|---|---|
| 1 | POWER ON | XX | 0 1 | 0 0 | | |
| 2 | A | XX | 0 2 | 0 0 | A | A |
| 3 | BC | XX | 0 8 | 0 0 | A B C | A B C |
| 4 | D | XX | 1 0 | 0 8 | A B C D | A B C D |
| 5 | E | XX | 2 0 | 1 8 | A B C D E | A B C D E |
| 6 | F | XX | 4 0 | 3 8 | A B C D E F | A B C D E F |
| 7 | G | XX | 8 0 | 3 8 | A B C D E F G | A B C D E F G |
| 8 | CR | XX | 0 1 | 0 0 | | |

FIG. 3

| STEP | KEY OPERATION | XX / XX | $(UDL\ 1)_H$ | $(UDL\ 2)_H$ | LINE · BUFFER | PRINT |
|---|---|---|---|---|---|---|
| 1 | POWER ON | XX | 0 1 | 0 0 | | |
| 2 | A | XX | 0 2 | 0 0 | A | A |
| 3 | BC | XX | 0 8 | 0 0 | A B C | A B C |
| 4 | D | XX | 1 0 | 0 8 | A B C D | A B C D |
| 5 | E | XX | 2 0 | 1 8 | A B C D E | A B C D E |
| 6 | F | XX | 4 0 | 3 8 | A B C D E F | A B C D E F |
| 7 | G | XX | 8 0 | 3 8 | A B C D E F G | A B C D E F G |
| 8 | CR | XX | 0 1 | 0 0 | | |

PRINTER WITH UNDERLINING FUNCTION

This application is a continuation of application Ser. No. 045,182 filed Apr. 30, 1987, now abandoned and parent application Ser. No. 754,440 filed July 12, 1985, now abandoned.

BACKGROUND OF THE INVENTION

1. Field of the Invention

The present invention relates to a printer having an underlining function, and more particularly to a printer having a text memory for storing a keyed-in text which is capable of storing digits to be underlined in a line by one bit per digit.

2. Description of the Prior Art

In a prior art electronic typewriter having a text memory and a underlining function, a keyed-in character string with an underline is stored in the memory by (1) using one bit in each character code as a discrimination bit to indicate presence or absence of underline, or (2) inserting a code to indicate start of underline before a digit from which the underline starts and a code to indicate end of underline after a digit at which the underline ends.

In the method (1), one bit in each character code is occupied by the underline bit and hence the number of characters which can be stored is reduced to one half. In the method (2), twice as high a memory capacity is required when a broken line is to be stored.

SUMMARY OF THE INVENTION

It is an object of the present invention to provide a novel printer which is free from the problem encountered in the prior art printer and which can efficiently store information on character positions at which an underline is marked.

In order to achieve the above object, the printer having the underlining function of the present invention has an underline position memory, and one bit is allotted to each printable position, and the bits at the underline positions are inverted.

BRIEF DESCRIPTION OF THE DRAWINGS

FIG. 3 illustrates the operation of the embodiment.

DETAILED DESCRIPTION OF THE PREFERRED EMBODIMENT

Figure 1:
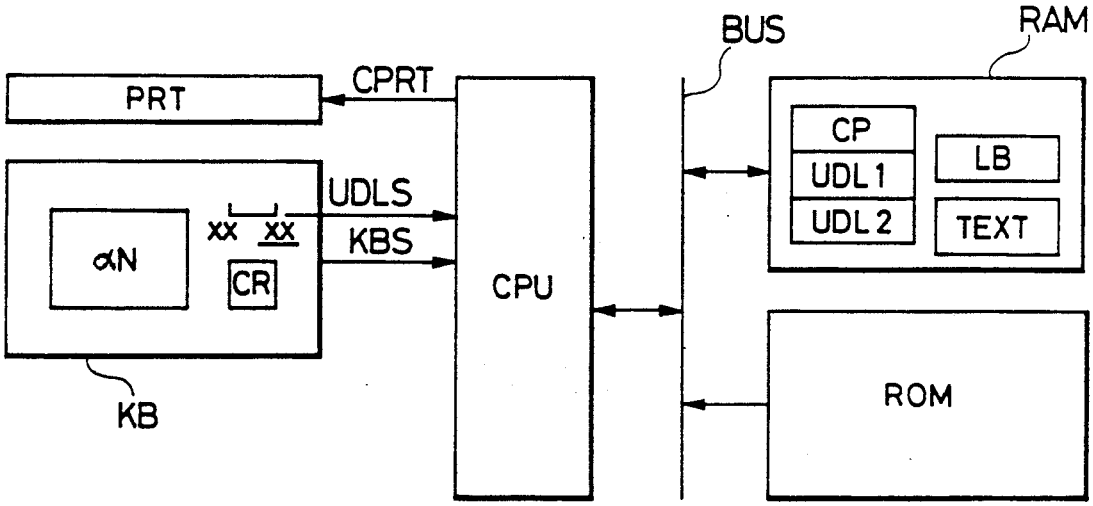
FIG. 1 is a block diagram of one embodiment of the present invention.

FIG. 1 is a block diagram of one embodiment of an electronic typewriter of the present invention. KB denotes a keyboard which has alphanumeric keys $\alpha$N for inputting A–Z and 0–9, a carriage return key CR and a switch ULSW for indicating the presence or absence of an underline. CPU denotes a control unit such as a microprocessor which may be a sequential control circuit having a clock pulse generator, a delay circuit, gate circuits and other logic circuits. The CPU functions in accordance with a control procedure stored in a ROM. PRT denotes a printer which prints out characters and numerics corresponding to the depressed keys in response to a print control signal CPRT from the control unit CPU. ROM denotes a read-only memory which stores therein microinstructions of the control procedure shown in FIG. 4 which is necessary to supply the control signals to the printer PRT and other units from the control unit CPU. RAM denotes a random access memory which stores therein operation status of the units or stores the keyed-in characters and numerics in a text area. It includes a line buffer LB, underline position memory areas UDL1 and UDL2, a cursor pointer CP and a text memory TEXT. BUS denotes a bus line for transferring a memory address or data between the control unit CPU and the ROM and RAM.

Figure 2:
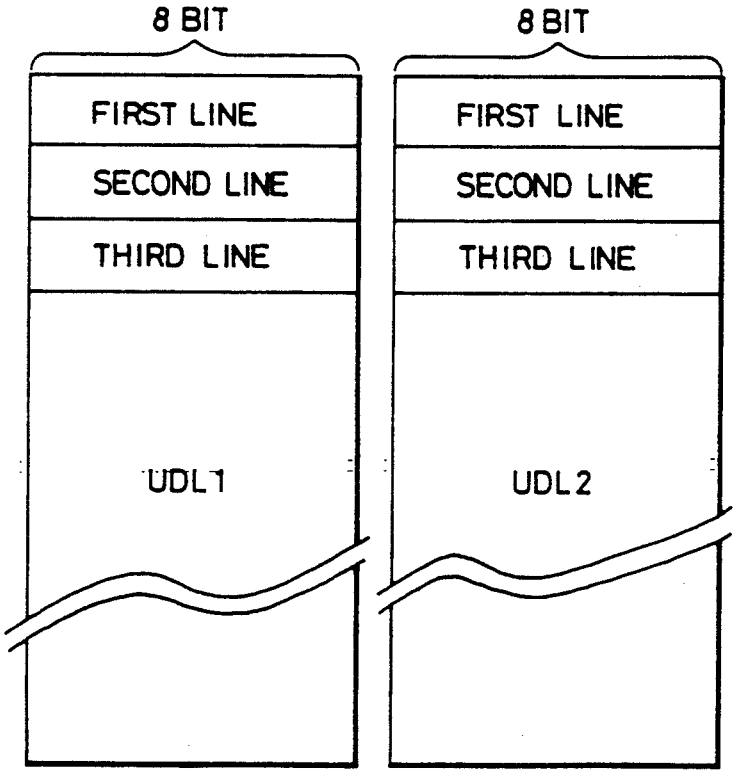
FIG. 2 is a bit configuration of an underline position memory in the embodiment.

In the present embodiment, the RAM includes the underline position memory areas UDL1 and UDL2 each having the same number of bits as the number of print digits of the printer PRT. For example, when the number of print digits (print width) of the printer PRT is eight digits, the underline position memory areas (hereinafter referred to as underline memories) UDL1 and UDL2 each has an 8-bit length as shown in FIG. 2. Accordingly, if the character memory area (not shown) in the RAM represents each character by one byte (8 bits), 256 characters can be represented.

The contents of the underline memories UDL1 and UDL2 have a relation of $$(UDL2)=(UDL1)+(UDL2)$$

where the symbol + represents a logical OR. The reason therefor will be explained later.

Figure 4:
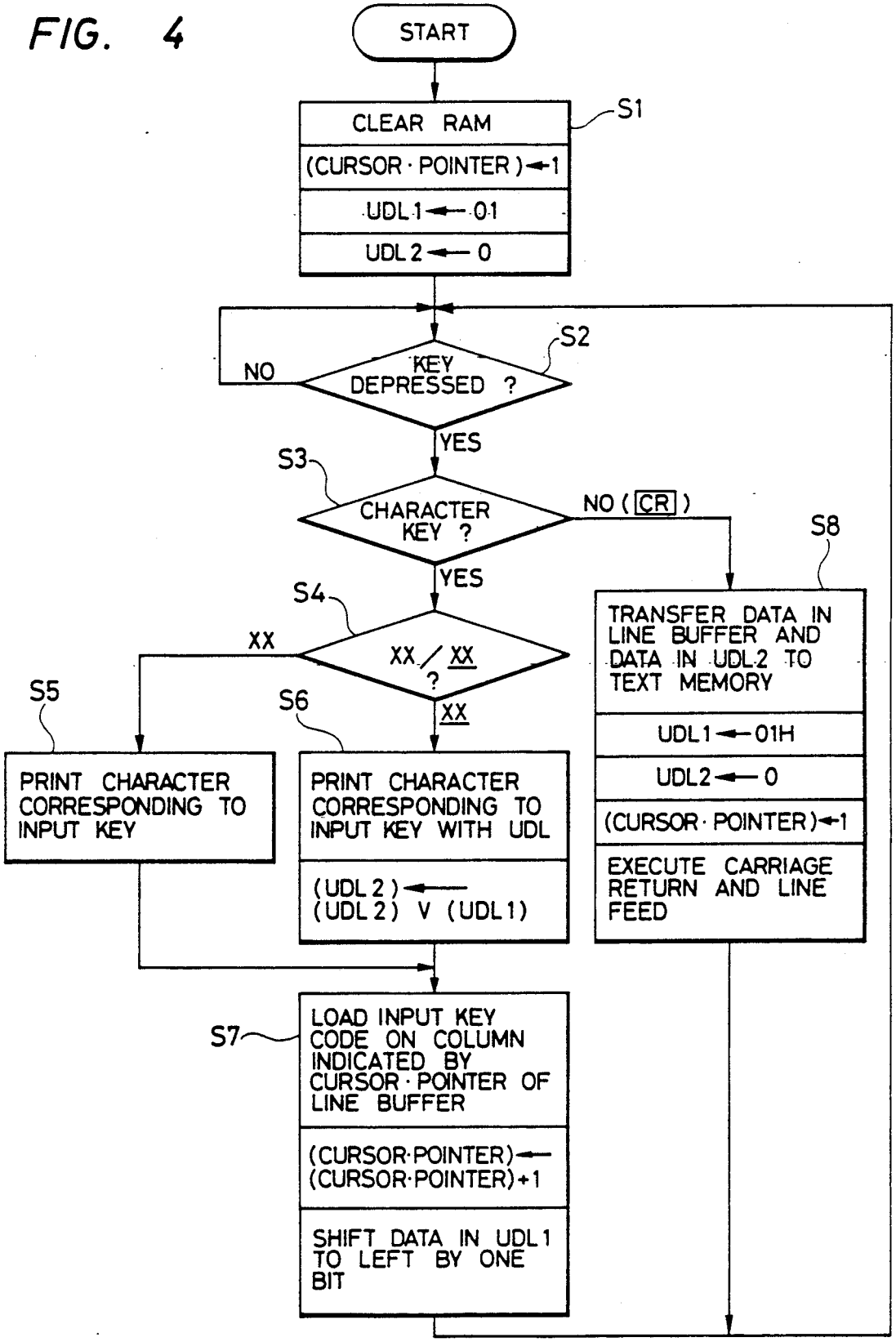
FIG. 4 is a control flow chart of the embodiment.

FIG. 3 illustrates the operation of the present embodiment by the key operation and FIG. 4 shows a flow chart of a control procedure. In the present embodiment, the underline memories UDL1 and UDL2 each has an eight-bit length.

Figure 5:
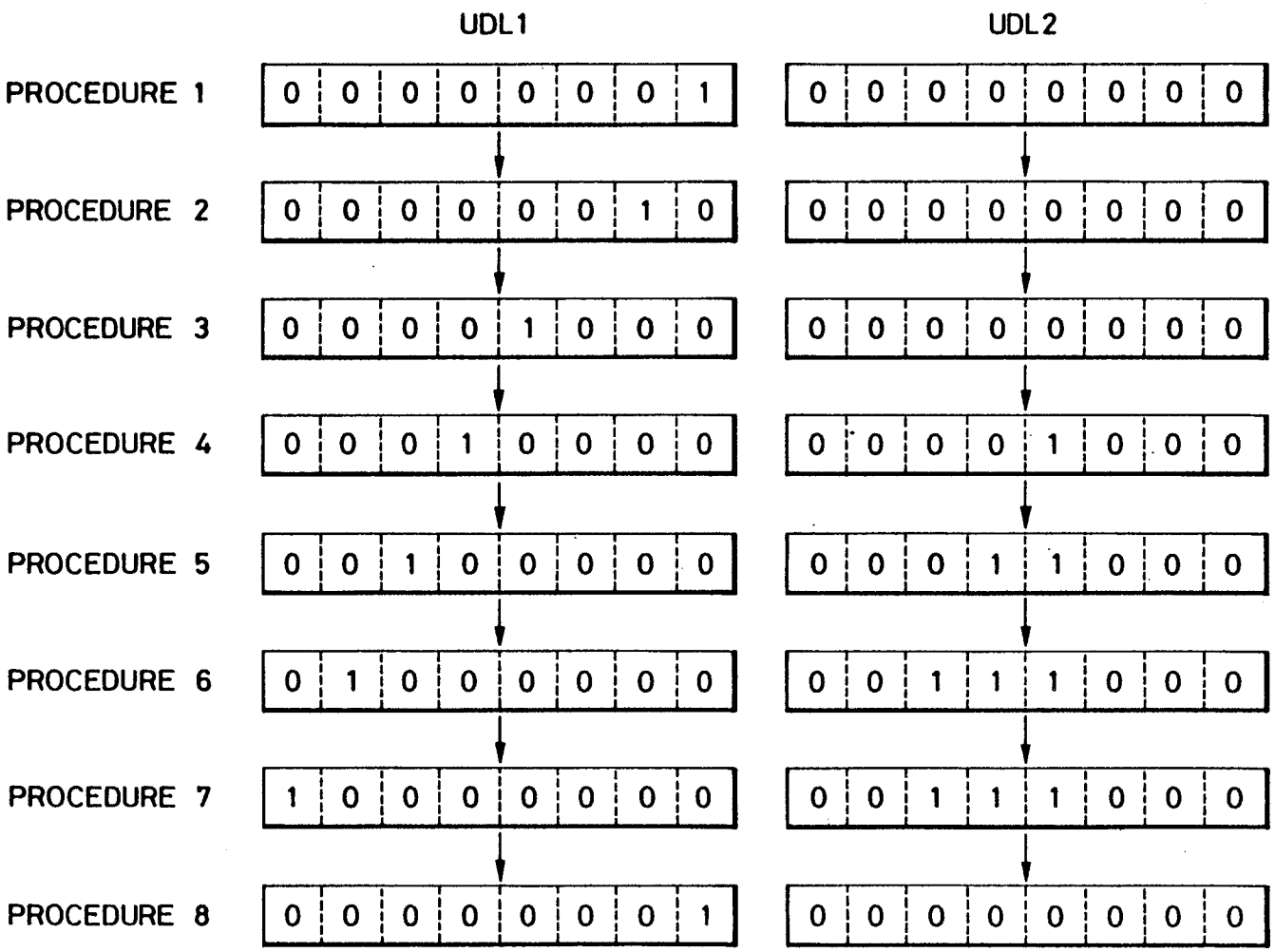
FIG. 5 illustrates the operation of the embodiment.

FIG. 5 shows bit contents of the underline memories UDL1 and UDL2.

The operation of the present embodiment is explained with reference to FIGS. 3 to 5.

As a power is turned on in a procedure 1, the RAM is cleared in a step S1, and "1" (decimal notation) is set in the cursor pointer, "1" (hexadecimal notation) is set in the UDL1 and "0" (hexadecimal notation) is set in the UDL2. In a step S2, a control loop for watching the depression of key is carried out.

In a procedure 2, when the key A is depressed, whether a key input signal is entered by the depression of the character key or not is checked in a step S3. If the depression of the character key is detected in the step S3, the set position of the underline selection switch ULSW is checked in a step S4. Since the underline is not designated in the procedure 2, a character corresponding to the input key signal is printed in a step S5.

In a step S7, the input key code is stored at a digit pointed by the cursor pointer of the line buffer and then the content of the cursor pointer is incremented by one. The data "1" in the UDL1 is shifted left by one bit position to change the content of the UDL1 to "2" (hexadecimal notation).

In a procedure 3, the keys B and C are depressed and "BC" is printed by the printer PRT in the same manner as the procedure 2. "ABC" is now stored in the line buffer and "8" (hexadecimal notation) is stored in the UDL1. Similarly, "4" (decimal notation) is stored in the cursor pointer.

In a procedure 4, the underline selection switch ULSW is switched to XX. When the key D is depressed, steps S3, S4 and S6 are carried out. In the step S6, the input character D and an underline are printed, and the data "0" (hexadecimal notation) in the UDL2 and the data "8" (hexadecimal notation) in the UDL1 and logically ORed and the result "8" (hexadecimal notation) is stored in the UDL2.

As "8" (hexadecimal notation) is stored in the UDL2, it means that "1" is stored in the fourth bit from the least significant bit. Thus, the fourth bit indicates the underline for the fourth keyed-in character "D".

In a step S7, the input key code is stored in the digit pointed by the cursor pointer of the line buffer. The content of the cursor pointer is then incremented by one and the data in the UDL1 is shifted left. As a result, "10" (hexadecimal notation) is stored in the UDL1.

In procedures 5 and 6, the keys E and F are sequentially depressed and the characters E and F with underlines are printed and "38" (hexadecimal notation) is stored in the UDL2. This indicates that "1's" are stored in the fourth to seventh bits of the UDL2, as seen from FIG. 5. The print positions corresponding to those bits correspond to the underline positions.

Then, the underline selection switch ULSW is switched to XX (no underline) and the character key G is depressed. Thus, the character "G" is printed as shown in a procedure 7 and "A B C D E F G" is stored in the line buffer and "38" (hexadecimal notation) is stored in the UDL2.

Finally, in a procedure 8, the carriage return key CR is depressed and a step S8 is carried out. In the step S8, the data in the line buffer and the data in the UDL2 are transferred to the text memory area in the RAM. Then, "1" is stored in the UDL1, "0" is stored in the UDL2 and "1" is stored in the cursor pointer, and the carriage return and the line feed are carried out.

In accordance with the present invention, the underline position memory having the same number of bits as the number of print digits of the printer is provided separately from the line buffer. Accordingly, the underline can be printed without reducing the number of different print characters or increasing the capacity of the line buffer.

I claim:

1. A typewriter comprising:

input means for entering character and underscore signals;

discrimination means connected to said input means for detecting whether or not an underscore signal indicating an underscore exists when a character signal representative of a character is entered by said input means;

first memory means connected to said input means for storing the character signal entered by said input means;

second memory means connected to said discrimination means for storing the underscore signal in response to a detection by said discrimination means that the underscore signals exists when the character signal is entered by said input means, said secondary memory means including a first storage area for storing information regarding the intended print position of the character entered by said input means and a second storage area for storing the underscore signal entered by said input means, said second storage area to store said underscore signal of said second memory means being smaller than a storage area to store one of said character signals in said first memory means;

input control means for writing position information of the entered character in said first storage area in response to the entering of the character by said input means;

control means responsive to the entered character from said input means for storing in said second storage area the result of logically adding the contents of said first and second storage areas, and when the underscore signal exists; and output means for printing characters with underscore in accordance with a pair read out from said second memory means, and said first memory means.

2. A typewriter according to claim 1, further comprising means for generating an address which is used for storing the character signal in said first memory means.

3. A typewriter according to claim 2, wherein said address generating means includes address memory means, the storage capacity of which is equal to that of said second memory means.

4. A typewriter according to claim 3, further comprising means for taking the logical sum of the contents of said address memory means and the contents of said second memory means.

5. A typewriter according to claim 1, wherein said input means includes a keyboard having a key for entering the character signal and a mode key for entering the underscore signal.

6. A typewriter according to claim 1, further comprising means responsive to a carriage return signal entered by said input means for initializing said first and second memory means.

7. A typewriter comprising:

input means for entering character, underscore and carriage return signals;

first memory means connected to said input means for storing a character signal entered by said input means, said first memory means having a capacity sufficient for the storage of at least the number of characters printable by the typewriter in one line;

second memory means for storing an underscore signal entered by said input means indicating that the character represented by the character signal entered by said input means and stored in said first memory means is to be underscored, wherein the number of bits comprising the underscore signal is less than the number of bits comprising the character signal;

third memory means for storing the contents of said first and second memory means, said third memory means storing as a pair the respective contents of said first and second memories which are partitioned by a carriage return signal; and means responsive to a carriage return signal entered by said input means for transferring a pair of the respective contents in said first and second memory means to said third memory means, and output means for printing characters with underscore in accordance with the pair of the contents read out from the third memory.

8. A typewriter according to claim 7, further comprising means for generating an address which is used for storing the character signal in said first memory means.

9. A typewriter according to claim 8, wherein said address generating means includes address memory means, the storage capacity of which is equal to that of said second memory means.

10. A typewriter according to claim 9, further comprising means for taking the logical sum of the contents of said address memory means and the contents of said second memory means.

11. An information processing apparatus comprising:

input means for entering character and underscore signals;

discrimination means connected to said input means for detecting whether or not an underscore signal exists when a character signal is entered by said input means;

print means for printing the character represented by the character signal, either underscored or not, according to the detected result;

first memory means connected to said input means for storing the character signal entered by said input means;

second memory means for storing the underscore signal entered by said input means;

third memory means for storing information regarding the intended print position of the character entered by said input means;

input control means in response to every entering of the character by said input means, for writing the position information of the entered character in said third memory means;

control means responsive to said discrimination means for storing the underscore signal in said second memory means in a manner dependent on the position information stored in said third memory means;

fourth memory means for storing a pair of the contents of information stored in said first and second memory means; and means responsive to each of carriage return signals entered by said input means for sequentially storing the pair of the contents in said first and second memory means to said fourth memory means, with the pair of contents of said first and second memory means in response to each of the carriage return signals being printed by said means.

12. A typewriter according to claim 11, wherein said input means includes a keyboard which has a key for entering the character signal and a mode key for entering the underscore signal.

13. A typewriter according to claim 11, further comprising means for generating an address which is used for storing the character signal in said first memory means.

14. A typewriter according to claim 13, wherein said address generating means includes address memory means, the storage capacity of which is equal to that of said second memory means.

15. A typewriter according to claim 14, further comprising means for taking the logical sum of the contents of said address memory means and the contents of said second memory means.

* * * * *

UNITED STATES PATENT AND TRADEMARK OFFICE
CERTIFICATE OF CORRECTION

PATENT NO. : 5,002,409 Page 1 of 2

DATED : March 26, 1991

INVENTOR(S) : SHIGERU MATSUYAMA

It is certified that error appears in the above-identified patent and that said Letters Patent is hereby corrected as shown below:

ON THE TITLE PAGE:

*At Attorney, Agent, or Firm*,
"Fitzpatrick, Cella, Harper, Scinto" should read
--Fitzpatrick, Cella, Harper & Scinto--.

COLUMN 1

Line 18, "a" (first occurrence) should read --an--.

COLUMN 2

Line 67, "XX." should read --XX.--.

COLUMN 3

Line 4, "and" (first occurrence) should read --are--;
Line 58, "signals" should read --signal--; and
Line 60, "secondary memory means" should read
--second memory means--.

PRINTER'S TRIM LINE

UNITED STATES PATENT AND TRADEMARK OFFICE

CERTIFICATE OF CORRECTION

PATENT NO. : 5,002,409 Page 2 of 2

DATED : March 26, 1991

INVENTOR(S) : SHIGERU MATSUYAMA

It is certified that error appears in the above-identified patent and that said Letters Patent is hereby corrected as shown below:

COLUMN 4

Line 12, "means," should read --means--;
Line 52, "first and second memories" should read --first and second memory means--; and
Line 60, "third memory." should read --third memory means--.

Signed and Sealed this

Fifteenth Day of December, 1992

*Attest:*

DOUGLAS B. COMER

*Attesting Officer*

*Acting Commissioner of Patents and Trademarks*